United States Patent [19]

Hirai

[11] 3,973,382

[45] Aug. 10, 1976

[54] YARN GUIDE DEVICE FOR AN OPEN-END SPINNING MACHINE

[76] Inventor: Hironori Hirai, 8-1, Kaidenhigashi-Tsukamoto, Nagaokakyo, Kyoto, Japan

[22] Filed: Feb. 3, 1975

[21] Appl. No.: 546,735

[30] Foreign Application Priority Data

Feb. 12, 1974 Japan ..... 49-17400

[52] U.S. Cl. ..... 57/58.89

[51] Int. Cl.[2] ..... D01H 1/12

[58] Field of Search ..... 57/34 R, 58.89–58.95

[56] References Cited

UNITED STATES PATENTS

| | | | |
|---|---|---|---|
| 3,324,642 | 6/1967 | Meimberg | 57/58.95 |
| 3,360,917 | 1/1968 | Kubory et al. | 57/58.95 |
| 3,445,993 | 5/1969 | Vorisek | 57/58.95 X |
| 3,481,128 | 12/1969 | Landwehrkamp et al. | 57/58.89 |
| 3,492,804 | 2/1970 | Landwehrkamp et al. | 57/58.95 X |
| 3,650,104 | 3/1972 | Shepherd et al. | 57/58.91 |
| 3,685,272 | 8/1972 | Greenwood et al. | 57/58.95 |
| 3,698,174 | 10/1972 | Boucek et al. | 57/58.95 |
| 3,834,145 | 9/1974 | Ellingham et al. | 57/58.95 X |
| 3,834,147 | 9/1974 | Havranek et al. | 57/58.89 |

*Primary Examiner*—Donald E. Watkins
*Attorney, Agent, or Firm*—Whittemore, Hulbert & Belknap

[57] ABSTRACT

This invention relates to a yarn guide device for an open-end spinning frame, wherein said yarn guide device comprises a navel with a yarn guide opening arranged around the rotational axis of the rotor, and a guide roller with a yarn contact surface positioned substantially on an extension of the rotational axis of the rotor. The spun yarn is taken out through the navel substantially along the rotational axis of the rotor and is deflected for the first time as it passes along the guide roller.

3 Claims, 4 Drawing Figures

YARN GUIDE DEVICE FOR AN OPEN-END SPINNING MACHINE

BACKGROUND OF THE INVENTION

In an open-end spinning frame, it is highly recommendable that the spun yarn be taken out from the rotor and wound on a winding package without any bend or deflection in the course of its passage from the rotor to the winding package. In effect, the spun yarn cannot choose but be deflected in its passage because of the necessity to make the spinning frame compact in size and elevate its operating efficiency. Thus, in a conventional spinning frame, the yarn is passed through a spinning tube mounted on and opening obliquely into a navel and is guided further therefrom around a fixed guide roller. Such the arrangement of the guide poses no problem when the rotational speed of the rotor should be in the order of 30,000 r.p.m. With the recent tendency towards a higher speed of the rotor which may even exceed 50,000 r.p.m., the spinning tension would be increased beyond the strength of the spun yarn, thus resulting in the occurrence of yarn breakage.

The present invention envisages to provide a yarn guide device which is free from such defect and which can be adapted not only for the high-speed spinning but for the low-speed spinning for the formation of the high-quality yarn.

SUMMARY OF THE INVENTION

This invention relates to a yarn guide device for an open-end spinning machine and more specially relates to a yarn guide device comprising a navel with a yarn guide opening arranged around the rotational axis of the rotor, and a guide roller with a yarn contact surface positioned substantially on an extention of the rotational axis of the rotor. In the present invention, the spun yarn is taken out through the navel substantially along the rotational axis of the rotor and is deflected for the first time as it passes along the guide roller.

It is a primary object of the present invention to provide a yarn guide device whereby the spinning tension may be reduced to prevent yarn breakage resulting from the excess spinning tension and to improve the yarn quality.

Another object of the present invention is to provide a yarn guide device wherein the occurrence of yarn breakage may be prevented even at the high-speed rotation of the rotor which may be in the order of 50,000 r.p.m. or more.

Still another object of the present invention is to improve the yarn quality not only with the high-speed spinning but with the low speed spinning.

BRIEF DESCRIPTION OF THE INVENTION

DETAILED DESCRIPTION OF THE INVENTION

An embodiment of the present invention will be explained by referring to the accompanying drawings showing the inventive device and the comparable prior-art yarn guide device.

Figure 1:
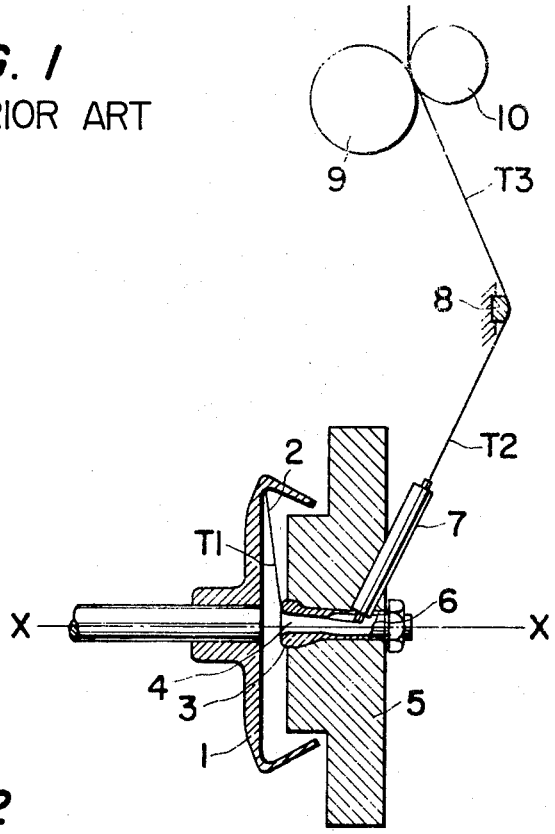
FIG. 1 PRIOR ART
FIG. 1 is a side elevation, partially in section, of the conventional rotor and the yarn guide device associated therewith.

In FIG. 1 showing a conventional yarn guide device, fibers are supplied into a rotor 1 through an inlet duct for the fibers, not shown, for spinning the yarn 2. The spun yarn 2 is taken out being guided by a navel 3 which has a yarn guide opening 4 arranged around an extension of the rotational axis of the rotor. The yarn guide opening 4 is not formed for the overall length of the navel plate 5, but it is stopped by a plug 6 at an end remote from the rotor. A tube 7 is mounted so as to be opened obliquely into a chamber thus defined in the navel 3. The yarn 2 is deflected for the first time at the inlet of the yarn guide opening 4, then at the inlet of the tube 7 and finally at a fixed guide 8. The yarn is then withdrawn by a delivery roller 9 and a nip roller 10 and wound around a winding package which is omitted from the drawing for the sake of simplicity. The yarn is placed under varying tension along its passage from the rotor to the winding package in such a manner that the tension $T_1$ at a section defined between the rotor and the yarn guide opening, the tension $T_2$ at a section defined between the inlet of the spinning tube and the guide 8 and the tension $T_3$ at a section defined between the guide 8 and the rollers 9, 10 will obey the relationship $T_1<T_2<T_3$. The yarn tension $T_3$ resulting from such arrangement of the navel and the guide is shown in a graphic chart in FIG. 2 wherein the yarn tension is plotted on the vertical axis and the number of revolutions of the rotor is plotted on the horizontal axis. An explanation of FIG. 2 will be made hereinafter in more detail.

Figure 3:
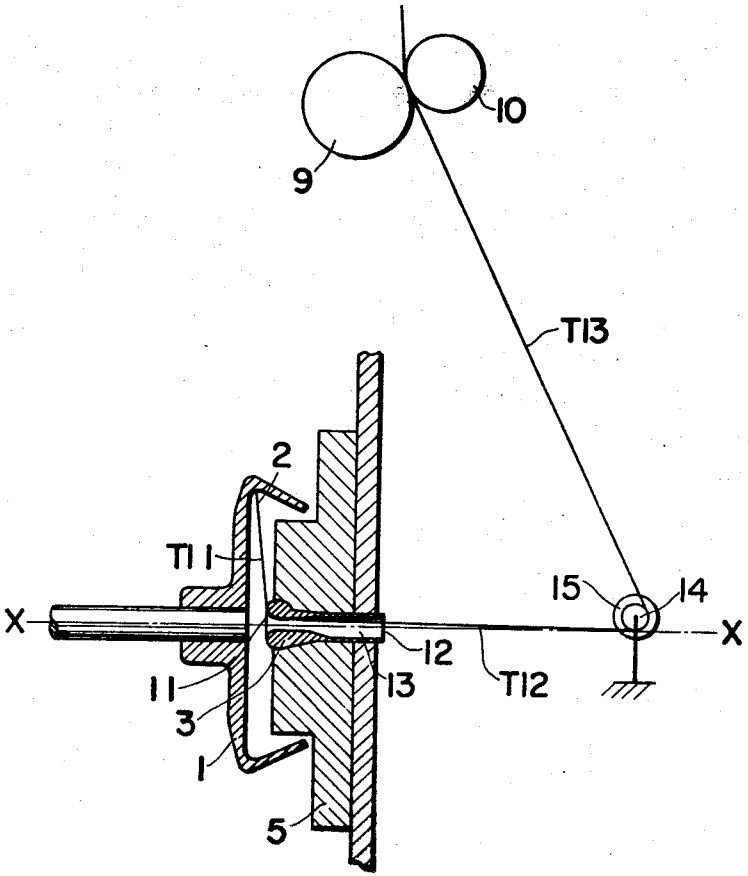
FIG. 3 is a side elevation, partly in section, of a preferred embodiment of the present invention.

An embodiment of the present invention will be explained by referring to FIG. 3, wherein the same parts as in FIG. 1 are shown by the same reference letters or numerals. A navel 3 has a through yarn guide opening 13 extending from the yarn inlet 11 to the yarn outlet 12 and arranged arund the rotational axis X — X of the rotor 1. The navel 3 can be secured to the navel plate 5 with an adhesive or secured thereto at the yarn outlet 12 with a nut or the like fastening means. The yarn can thus be withdrawn in the direction of the rotational axis of the rotor. In the inventive device shown in FIG. 3, the tube 7 which is mounted in a direction to intersect the navel in the conventional device is omitted. If desired, it is naturally possible to provide such tube, on the condition that the tube has its bore or yarn guide opening located around the extension of the rotational axis X — X of the rotor. Such an arrangement will not give rise to the yarn deflection such as is encountered with the conventional device shown in FIG. 1. This feature is highly advantageous for maintenance of good yarn quality in consideration that the good yarn quality cannot be expected when the yarn being spun should be subjected to rather severe tension and deflection in the course of yarn passage from the rotor to the winding package.

The numeral 14 designates a guide roller. The yarn contact surface 15 of the guide roller 14 is located substantially on an extension of the rotational axis of the rotor. It was acknowledged that the number of baloons of the spun yarn formed intermediate the inlet 11 of the navel 3 and the roller 14 was changed with the distance between the roller 14 and the navel outlet 12, but the influence of such distance on the yarn tension to be described later was not so decisive. Also, the contact surface 15 of the guide roller 14 can be shifted relative to the rotational axis X — X of the rotor without any appreciable changes in the yarn tension. The contact surface 15 may be displaced from the rotation axis of the rotor within the distance less than the semi-diameter of the yarn guide opening of the navel.

Figure 2:
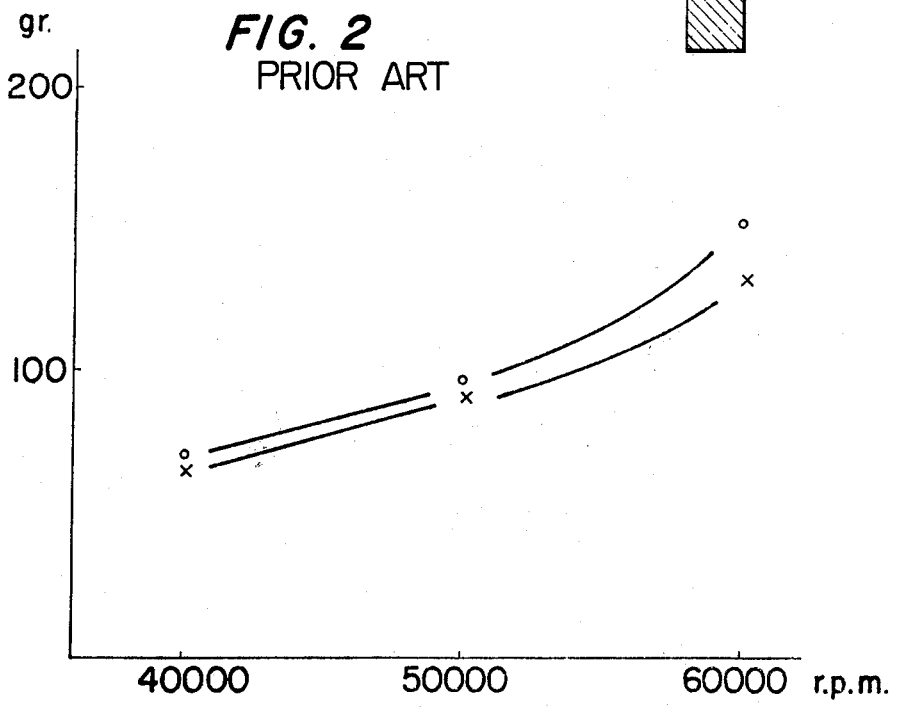
FIG. 2 PRIOR ART
FIG. 2 is a chart showing the spinning tension versus the rotational speed of the rotor which is used in conjunction with the conventional yarn guide device.
Figure 4:
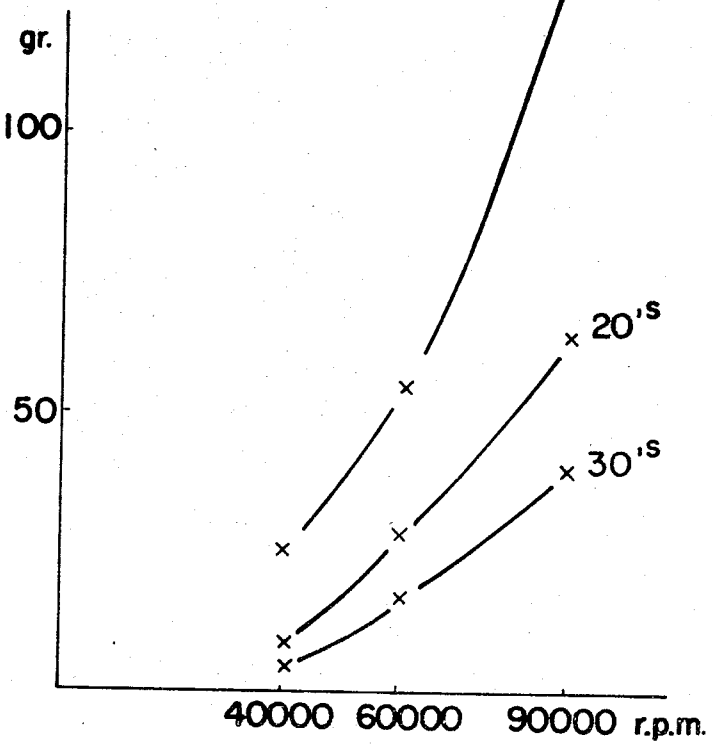
FIG. 4 is a charge similar to FIG. 2 and showing the spinning tension versus the rotational speed of the rotor which is used in conjunction with the yarn guide device of the present invention.

In the embodiment shown in FIG. 3, the yarn tension $T_{11}$ as measured in a section between the rotor 1 and the navel 3, the yarn tension $T_{12}$ in a section between the navel 3 and the guide roller 14 and the tension $T_{13}$ is a section between the roller 14 and the delivery roller 9 will obey the relationship $T_{11}<T_{12}<T_{13}$, as described with reference to FIG. 1. The measured values of the yarn tension $T_3$ and the yarn tension $T_{13}$ are shown in FIGS. 2 and 4. In FIG. 4, the tension was measured of the cotton yarn of 10 counts (10'S), 20 counts (20'S) and 30 counts (30'S) with use of a navel with a mirror-finished inner plated surface. In FIG. 2, the tension was measured of the cotton yarn of 10 counts (10'S) with use of a navel with an aventurine inner plated surface and a navel with a mirror-finished inner plated surface.

In FIG. 2, a curve —*o*—*o*— represents the tension of the spun yarn taken out through the navel provided with the aventurine innerplated surface and a curve —*x*—*x*— represents the tension of the spun yarn taken out through the navel provided with the mirror-finished inner plated surface. In both FIGS. 2 and 4, the yarn tension (expressed in grammes) is plotted on the vertical axis, while the rotational speed of the rotor (expressed in r.p.m.) is plotted on the horizontal axis.

In FIG. 4, the yarn tension of the 10-count cotton yarn amounts to 150 grammes for 90,000 r.p.m. of the rotor while in FIG. 2, that of the cotton yarn of the same count amounts is slightly less than 150 grammes for 60,000 r.p.m. of the rotor. It should also be mentioned that the spinning operation is impossible to perform with the conventional device shown in FIG. 1 when the rotor speed should exceed 60,000 r.p.m. and thus the measurement of the yarn tension is not feasible for the higher rotor speed.

The present device thus enables the yarn of high quality to be spun with the least risk of yarn breakage.

What is claimed is:

1. A yarn guide device for an open-end spinning frame comprising a rotor rotatable at speeds in excess of 60,000 r.p.m. having an open end, a navel plate positioned over the open end of the rotor, a navel having an axially extending yarn guide opening therethrough secured in the navel plate on the axis of rotation of the rotor through which spun yarn is removed from the rotor axially of the axis of rotation of the rotor, a guide roller positioned on the opposite side of the navel plate from the rotor having an axis of rotation perpendicular to the axis of rotation of the rotor and a peripheral surface for initial engagement of yarn withdrawn from the rotor through the navel on the axis of rotation of the rotor and a cooperating delivery roller and nip roller positioned to receive the spun yarn from the guide roller to effect an angle of spun yarn between the navel, guide roller and delivery and nip rollers of less than 90° which delivery and nip rollers have an axis of rotation parallel to the guide roller and perpendicular to the axis of rotation of the rotor whereby rotational speeds of greater than 60,000 r.p.m. are effected without breaking of the spun yarn due to high spinning tension.

2. Structure as set forth in claim 1 wherein the peripheral contact surface of the guide roller is equal to or less than one-half the diameter of the guide roller from the axis of rotation of the roller.

3. Structure as set forth in claim 1 wherein the diameter of the opening through the navel is substantially larger than the diameter of the spun yarn withdrawn therethrough whereby ballooning of the yarn between the entrance to the navel and the guide roller is possible.

* * * * *